United States Patent [19]

Haer

[11] Patent Number: 4,539,718

[45] Date of Patent: Sep. 10, 1985

[54] DRAINPIPE STRAINER

[76] Inventor: Richard L. Haer, 9032B McConnell, Moses Lake, Wash. 98837

[21] Appl. No.: 593,027

[22] Filed: Mar. 23, 1984

[51] Int. Cl.[3] ..... E03C 1/26; E03C 1/264

[52] U.S. Cl. ..... 4/292; 4/255; 4/191; 4/295; 4/DIG. 14; 210/435; 210/447

[58] Field of Search ..... 4/255, 257, 256, 191, 4/206, 207, 292, 295, DIG. 14; 210/435, 447

[56] References Cited

U.S. PATENT DOCUMENTS

| | | | |
|---|---|---|---|
| 861,493 | 7/1907 | Bell | 210/447 |
| 1,217,763 | 2/1917 | Hirrich | 4/DIG. 14 |
| 1,817,376 | 8/1931 | Izquierdo | 210/447 |
| 3,834,539 | 9/1974 | Thompson | 210/447 |
| 3,904,523 | 9/1975 | Sierzega | 210/447 X |
| 3,935,602 | 2/1976 | Kale | 4/292 |
| 3,959,831 | 6/1976 | Hendricks | 4/295 |
| 4,032,455 | 6/1977 | Kale | 210/435 |
| 4,051,042 | 9/1977 | Tullier et al. | 210/447 |
| 4,164,048 | 8/1979 | Kampfer et al. | 4/DIG. 14 |
| 4,179,762 | 12/1979 | Barnhardt et al. | 4/191 |
| 4,230,582 | 10/1980 | Tuleja | 210/435 |
| 4,301,554 | 11/1981 | Wojcicki | 4/206 |

*Primary Examiner*—Henry K. Artis

*Attorney, Agent, or Firm*—Wells, St. John & Roberts

[57] ABSTRACT

A drainpipe straining device can be attached either through an existing cleanout hole within the drainpipe or can be releasably secured to the drainpipe through a radial hole formed in the pipe. The device includes a plug member having substantially axially extending bristles. The shank of the plug member may be received within the bore of a cleanout hole already provided in a drain structure, or releasably received within a bore formed in a ring adapted to be secured to a radial hole drilled into the drainpipe. The ring member can be secured by strap means to the drainpipe and held in place thereon to releasably receive the plug. Solid materials will be received and collected by the bristles on the drain plug and can be removed from the drainpipe simply by removing and cleaning the plug and associated bristles.

9 Claims, 6 Drawing Figures

DRAINPIPE STRAINER

FIELD OF THE INVENTION

The present invention relates to straining of liquids within drainpipes.

BACKGROUND OF THE INVENTION

Drainpipes invariably receive solids along with the waste liquids to be drained. A common plugging condition in typical households is caused from hair collecting in the drainpipes and eventually clogging the pipe.

Typical drain installations include a "trap" which is a sharply bent section of pipe. Traps are used to prevent gases from escaping back upwardly through the drainpipe to exit out the drain opening in the adjacent sink or tub. Drainpipes usually include a removable trap to facilitate cleaning. The trap must be removed for this purpose—a task not lightly undertaken by the typical homeowner. Furthermore, not all drain stoppages occur within the drain trap. Stoppage may occur away from the trap. When this happens, further measures must be taken to unplug the drain. Various chemicals and apparatus have been developed for this purpose. Perhaps the most common mechanical device is the "snake". A "snake" is an elongated wound wire that is sufficiently flexible to be guided through the drain and trap, seeking a clogged area. The snake is usually turned by hand or by an appropriate electric motor as it is fed into the drain. Snakes often require removal of the trap before they will function effectively.

Chemicals have been advertised to "dissolve" clogs in pipelines. But it is not unusual for the same chemicals to have a caustic, damaging effect on the associated plumbing.

Some drain traps are supplied with cleanout plugs. The plug can be removed and appropriate apparatus inserted through the plug hole to clean out the trap area. Other devices have been developed for stopping and accumulating solids within the drain trap area.

U.S. Pat. No. 4,230,582 discloses such a drain trap that includes a removable strainer means. A bottom section of the trap is removable to allow access to the straining device. It is pointed out that this is a complete trap arrangement and installation requires removal of the old drain trap and replacement with the trap including the integral cleanout.

Another somewhat similar trap arrangement is shown in U.S. Pat. No. 4,179,762. A tubular section of the trap is provided with a strainer attached to a threaded cap. The strainer fits through a tubular section of the trap and the cap is threadably engaged to one end of the tube section. A perforated disk is used as the strainer for collecting solid materials within one side of the trap.

U.S. Pat. No. 4,164,048 discloses another form of specialized drain trap including an angular flange that releasably receives a straining screen. The screen is removable through a cap threadably attached to the flange. The screen strains solids from the trap area.

Another trap arrangement is illustrated in U.S. Pat. No. 3,935,602. Again, this is a specialized trap assembly having a removable bottom section with an insertable strainer mounted therein. The strainer makes use of spaced sets of bristles to collect solids.

U.S. Pat. No. 1,217,763 shows another specialized trap arrangement wherein the plurality of bristles are arranged in a spiral fashion along a central shaft removably located within a section of the trap. The bristles are intended to collect solids in the trap area and can be removed for cleaning.

Another form of drain trap is shown in U.S. Pat. No. 4,301,554. Here a separate trap is provided with an integral, removable cleanout structure attached thereto. The cleanout includes removable straining fingers for collecting and removing solids from the draining waste liquids.

The above arrangements are directed primarily to the trap area of drainpipes and require either extensive modification to the drain trap or complete replacement thereof.

U.S. Pat. No. 3,959,831 discloses a number of stacked disks including radially extending bristles. These disks can be attached to a drain plug shank for the purpose of accumulating hairs and other solid particulates before the waste liquid reaches the trap.

A need remains for a device that will fit within the drainpipe at any convenient location for effectively straining drainage liquids and that can be easily removed for cleanout purposes. It is further desirable to obtain such a device that can be easily mounted to existing drainpipe structures without requiring extensive modification.

BRIEF DESCRIPTION OF THE DRAWINGS

The present invention is illustrated in the accompanying drawings, in which.

DETAILED DESCRIPTION OF THE PREFERRED EMBODIMENT

Figure 2:
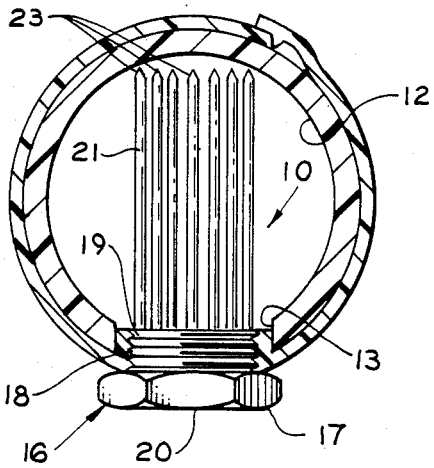
FIG. 2 is a sectional view through a drainpipe and the present device as attached thereto.

In compliance with the constitutional purpose of the Patent Laws "to promote the progress of science and useful arts" (Article 1, Section 8), applicant submits the following disclosure of the invention.

The present straining device is indicated by the reference numeral 10 in the accompanying drawings. The straining device 10 is attachable to an existing form of drainpipe 11 for removing solid material such as hair, etc., from liquids passing through the drainpipe interior bore 12.

Figure 1:
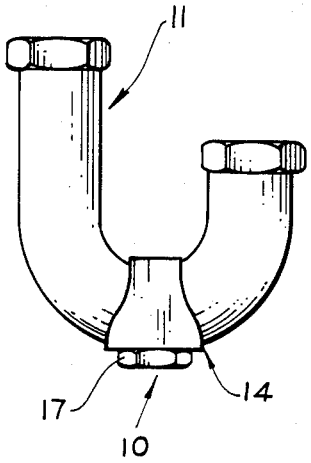
FIG. 1 is an elevation view of a drain with the present structure mounted thereto.
Figure 3:
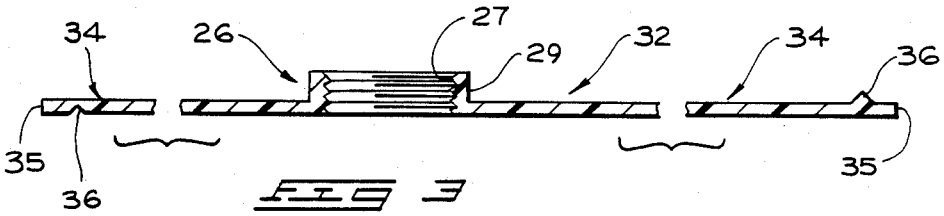
FIG. 3 is a ring and strap arrangement for the present device.

It is pointed out that the present device 10 can be secured within an appropriate radial hole 13 formed at any point along the length of the drainpipe. FIG. 1 shows the device 10 mounted at the bottom of a trap 14. FIG. 2 shows the device mounted to a straight section of drainpipe through an appropriate radial hole 13.

The radial hole 13 can be made by any of several conventional means such as a standard electric drill. Alternatively, if an existing drain trap includes a cleanout plug, the present plug member 16 (FIG. 4) can be used without requiring an auxiliary transverse hole 13.

Figure 4:
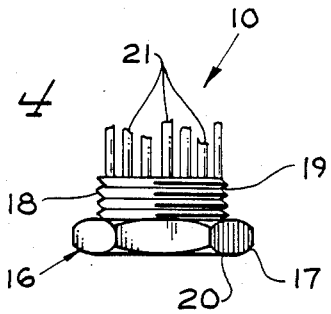
FIG. 4 illustrates the present plug structure.

The plug member 16 is shown in FIGS. 2 and 4. It includes a shank 17 extending along a central longitudinal axis. The shank 17 is provided with male threads 18 along its length from an end 19 to a headed end 20. The headed end 20 can be of conventional form for attachment to a typical tightening or removal tool such as a wrench.

Figure 6:
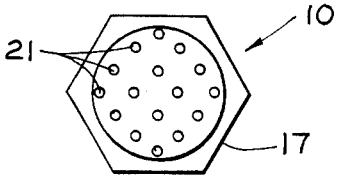
FIG. 6 is a plan view of a plug member of the present invention.
Figure 5:
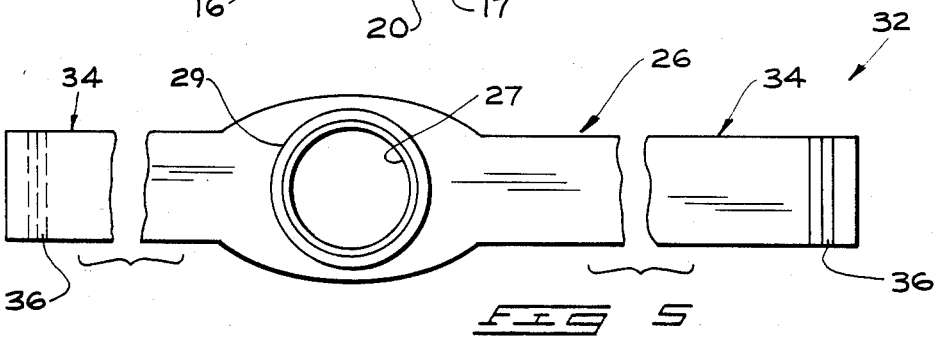
FIG. 5 is a top plan view of the strap and ring arrangement shown in FIG. 3.

A plurality of bristles 21 are secured to or are integral with the plug member 16. The bristles extend substantially axially in relation to the shank 17 from the end 19 to outward bristle ends 23. It is preferred that the bristles be arranged in staggered rows such that no two bristles 21 are closer than 0.100 inches to one another (FIG. 6). It is also preferred that the bristles 21 be approximately 0.062 inches in diameter. The dimensions have been found, by experimentation, to facilitate free drainage of fluids while the bristles act to catch solids, particularly hairs.

In practice both the plug body and bristles may be formed integrally of a plastic material as by injection molding. Alternatively, the bristles could be formed of metal and attached by spot welding or other conventional means to a metallic plug shank 17.

If the plug member is to be used with conventional cleanout plug holes, the size and nature of the threads 18 will be produced to correspond. The plug 16 can then simply be substituted for existing cleanout plug. But it is not typical that cleanout plugs are provided in conventional household plumbing.

The present device is also adapted to be mounted to any conventional drainpipe at any convenient location where a radial hole 13 can be bored. This is a fairly simple procedure especially where plastic drainpipes are used. Metal drainpipes are typically constructed of soft material and can also be easily drilled.

A ring member 26 is used for receiving and holding the plug member 16 in place within a hole 13 bored in the drainpipe 11. The ring member 26 is preferably formed of a flexible plastic material including an internal bore 27. The bore 27 may include female threads that will threadably receive the male threads 18 of the plug shank 17. The plug shank 17 may therefore be securely received within the bore of the ring and in sealed relationship therewith.

It is preferred that the ring member 26 be relatively rigid so the bore 27 will remain complementary to the configuration of the plug shank.

The ring member 26 also includes a peripheral wall 29. The wall 29 is complementary to the configuration of the radial hole 13 formed in the drainpipe. The wall will fit snugly within the opening to securely mount the ring member in place for receiving the plug 16. The peripheral wall may seat against the engaged surfaces of the radial hole 13 to seal and prevent seepage of drainage liquids from between the two engaged surfaces.

Means may be provided at 32 for securing the ring member 26 to the drainpipe 11. Means 32 may be comprised of an elongated strap 34 that extends to opposite ends 35 for enveloping or wrapping the drainpipe 11. The ends 35 may include overlapping engageable surfaces 36 provided with means for securing the ends together and holding the ring in place on the drainpipe and within the radial hole 13. This securing means may be a form of conventional fastening arrangement. Alternatively the surfaces can be simply glued together to secure the straps in position and firmly hold the ring in its seated position within the radial drainpipe hole 13.

The present arrangement can be secured to a drainpipe not having an existing cleanout hole by first drilling a radial hole into the drainpipe at any convenient location. The hole need not be located directly within the drain "trap". In fact, it may be desirable to locate the hole somewhere in the drain line between the trap and drain opening in the adjacent sink or tub.

The hole size is formed to correspond with the outside peripheral wall diameter of the ring member 26. The sized hole 13 will receive the ring member with the hole walls engaging corresponding wall surfaces 29 of the ring member 26. The straps 34 can be wrapped about the drainpipe and secured (by gluing or other means) to firmly hold the ring member 26 in place. The drain plug 16 can then be inserted. This may be done by threading the plug into the threaded ring bore 27. The threads perform a sealing function as well as securing the two members relative to one another. The plug member may also slightly expand the ring member to press the peripheral wall 29 more firmly against the walls of the radial drainpipe hole 13. This will enhance the seal between the drainpipe and ring.

As liquids drain past the present straining device 10, solids will accumulate on the inwardly projecting bristles 21. Hair and other debris will accumulate steadily while liquid flow through the device remains relatively free, due to the diameter and spacing of the bristles.

After a time it may be desirable to remove the plug member 16 to clean the bristles 21. This is done simply by threadably disengaging the plug member 16 from the ring member 26. The axial bristles 21 can be pulled through the bore 27, along with the collected solids. The collected material can then be brushed or washed from the bristles. The cleaned plug can then be reinserted and secured to the ring member for continued use.

Ease of use for the present device will encourage regular periodic cleaning of the drain to avoid future clogs that could result in an expensive call by a plumber or drain cleaning service. The device can be mounted at nearly any location along a drainpipe for easy access. Furthermore it does not require replacement of existing expensive plumbing equipment. It requires only minor modification in that formation of the radial hole 13 may be required if no existing cleanout hole is provided. A drilled radial hole 13, once formed and mounted with the ring member, will serve as the "cleanout hole" in which the present plug member 16 can be releasably secured.

In compliance with the statute, the invention has ben described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A pipe straining device for attachment to a drainpipe having a bored circular hole formed therein, said device comprising:

a ring member having a plug receiving central bore and a circular peripheral wall extending about the central bore and shaped to fit securely within the bored circular hole formed in the drainpipe;

a plug member having a headed end and a shank extending along an axis, releasably received through the central bore of the ring member;

a plurality of bristles spaced apart in relation to one another and extending from the shank to ends spaced axially therefrom; and means on the ring member for securing the ring member to the drainpipe with the peripheral wall securely engaged within the radial hole, comprised of a flexible strap of sufficient length to wrap around the drainpipe, and having means for securing the strap securely about the drainpipe, with the plug member extending into the bored hole and with its peripheral wall sealed against the bored hole wall.

2. The pipe straining device of claim 1 wherein the plug shank and ring bore are provided with interfitting male and female threads respectively that enable the plug member to be threadably attached to and removed from the ring member.

3. The pipe straining device of claim 1 wherein the bristles are axial in relation to the shank.

4. The drainpipe straining device of claim 1 wherein the bristles each have a cross-sectional diameter of approximately 0.062 inches.

5. The drainpipe strainer of claim 4 wherein the bristles are spaced apart from one another by a distance of at least 0.100 inches.

6. The drainpipe straining device of claim 1 wherein the bristles are spaced apart from one another by a distance of at least 0.100 inches.

7. The drainpipe straining device of claim 6 wherein the bristles are arranged in staggered rows along the threaded shank.

8. The drainpipe straining device of claim 7 wherein the bristles each have a cross-sectional diameter of approximately 0.062 inches.

9. The drainpipe strainer of claim 1, wherein the ring member and strap member are integral.

* * * * *